US011103921B2

(12) United States Patent
Richaud et al.

(10) Patent No.: US 11,103,921 B2
(45) Date of Patent: Aug. 31, 2021

(54) ASYMMETRIC SLAB NOZZLE AND METALLURGICAL ASSEMBLY FOR CASTING METAL INCLUDING IT

(71) Applicant: VESUVIUS U S A CORPORATION, Champaign, IL (US)

(72) Inventors: Johan Richaud, Cheval Blanc (FR); Martin Kreierhoff, Suedlohn (DE)

(73) Assignee: Vesuvius U S A Corporation, Pittsburgh, PA (US)

( * ) Notice: Subject to any disclaimer, the term of this patent is extended or adjusted under 35 U.S.C. 154(b) by 0 days.

(21) Appl. No.: 16/609,010

(22) PCT Filed: May 14, 2018

(86) PCT No.: PCT/EP2018/062420

§ 371 (c)(1),
(2) Date: Oct. 28, 2019

(87) PCT Pub. No.: WO2018/210772

PCT Pub. Date: Nov. 22, 2018

(65) Prior Publication Data

US 2020/0238373 A1 Jul. 30, 2020

(30) Foreign Application Priority Data

May 15, 2017 (EP) ..... 17171047

(51) Int. Cl.
*B22D 41/50* (2006.01)
*B22D 11/103* (2006.01)
(Continued)

(52) U.S. Cl.
CPC ..... *B22D 41/502* (2013.01); *B22D 11/103* (2013.01); *B22D 41/505* (2013.01);
(Continued)

(58) Field of Classification Search
CPC .... B22D 11/103; B22D 41/50; B22D 41/502; B22D 41/56
(Continued)

(56) References Cited

U.S. PATENT DOCUMENTS 5,402,993 A * 4/1995 Hofmann ..... B22D 41/50 266/236
5,775,552 A 7/1998 Pleschiutschnigg
(Continued)

FOREIGN PATENT DOCUMENTS

CN 1222104 A 7/1999
CN 201026526 Y 2/2008
(Continued)

*Primary Examiner* — Scott R Kastler
*Assistant Examiner* — Michael Aboagye
(74) *Attorney, Agent, or Firm* — Thomas Clinton

(57) ABSTRACT

A slab nozzle for use in a continuous slab casting installation is characterized by a specific geometry of the outer wall of a downstream portion thereof which is inserted in a slab mould cavity. The specific geometry promotes a "roundabout" effect whereby converging opposite streams of molten metal flowing towards two opposite flanks of the slab nozzle are each preferentially deviated towards one side of the slab nozzle where they can freely flow through the narrow channels formed between the slab nozzle and the slab mould cavity wall without impinging with one another. This prolongs the service life of the slab nozzle by substantially reducing the erosion rate of the outer wall thereof.

16 Claims, 9 Drawing Sheets

(51) Int. Cl.
*B22D 41/54* (2006.01)
*B22D 41/56* (2006.01)

(52) U.S. Cl.
CPC ..... *B22D 41/507* (2013.01); *B22D 41/54* (2013.01); *B22D 41/56* (2013.01)

(58) Field of Classification Search
USPC ..... 222/606, 591, 590, 594, 607; 164/488, 164/437, 337
See application file for complete search history.

(56) References Cited

U.S. PATENT DOCUMENTS 5,785,880 A * 7/1998 Heaslip ..... B22D 41/50 222/594
6,027,051 A * 2/2000 Heaslip ..... B22D 41/50 239/590.5
6,152,336 A 11/2000 Arvedi
6,341,722 B1 * 1/2002 Tolve ..... B22D 11/0642 222/594
10,569,326 B2 * 2/2020 Arvedi ..... B22D 11/041
2002/0063172 A1 5/2002 Shat et al.
2006/0243760 A1 * 11/2006 McIntosh ..... B22D 41/50 222/606

FOREIGN PATENT DOCUMENTS

CN 201442094 U 4/2010
CN 103231048 A 8/2013
DE 19505390 A1 8/1996
JP S62227558 A 10/1987
JP S62270261 A 11/1987
JP S63235050 A 9/1988
JP 2016131983 A 7/2016
WO 98/14292 A1 4/1998
WO 2013/004571 A1 1/2013

* cited by examiner

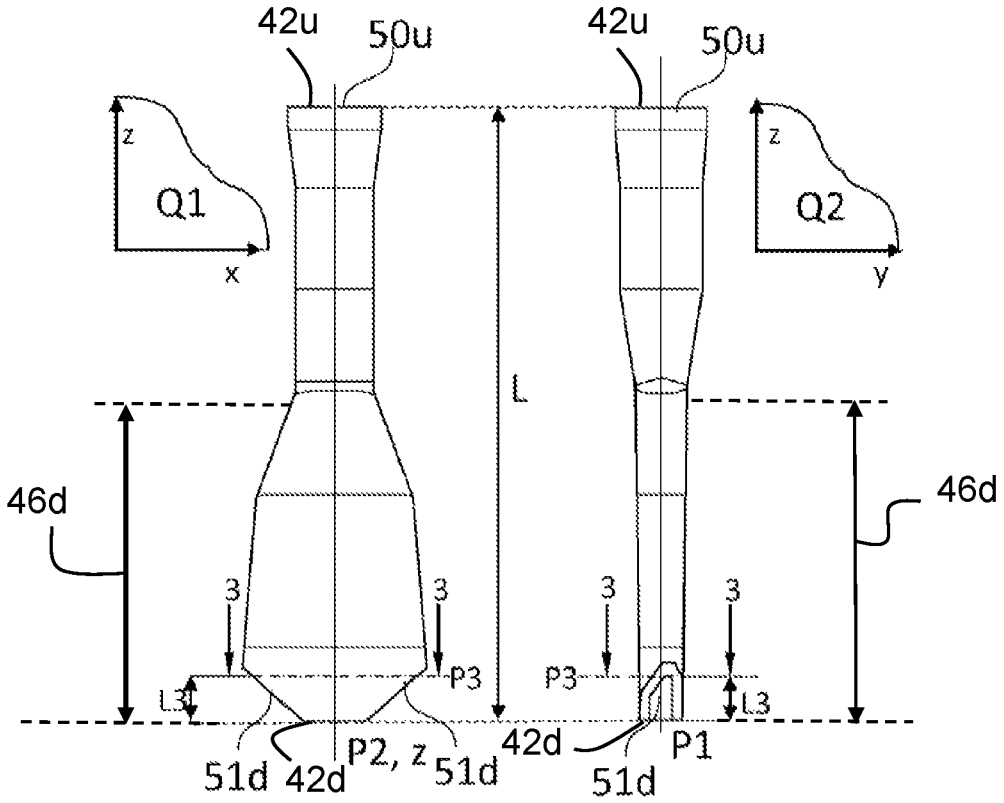
FIG. 5A FIG. 5B
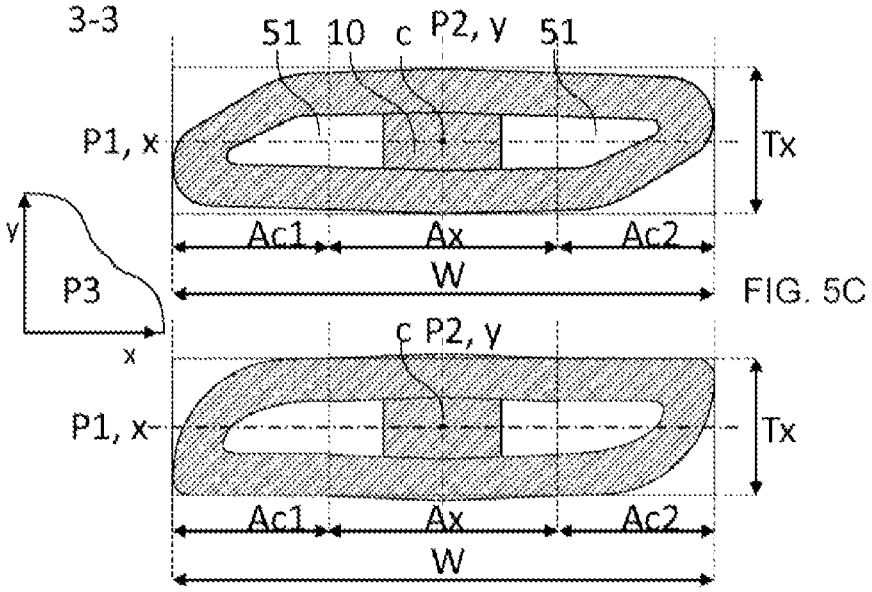
FIG. 5C
FIG. 5D

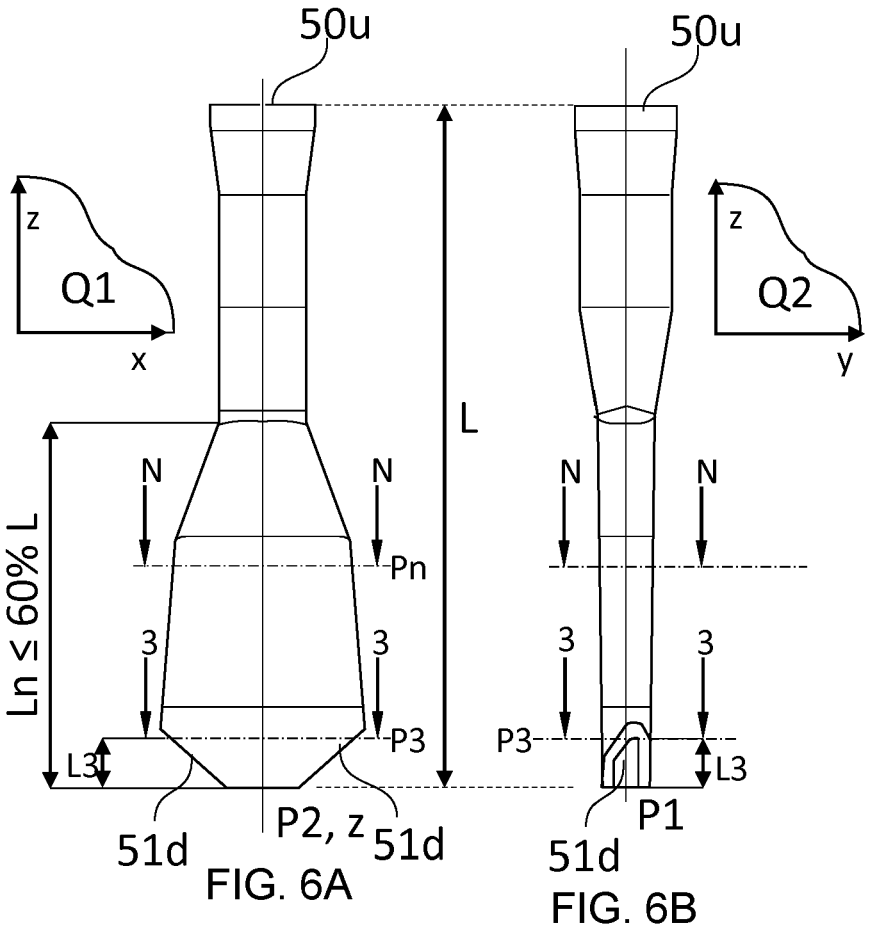
50u
50u
z
Q1
x
z
Q2
y
L
N
N
N
N
Pn
Ln ≤ 60% L
3
3
3
3
P3
P3
L3
L3
51d
P2, z
51d
51d
P1
FIG. 6A
FIG. 6B
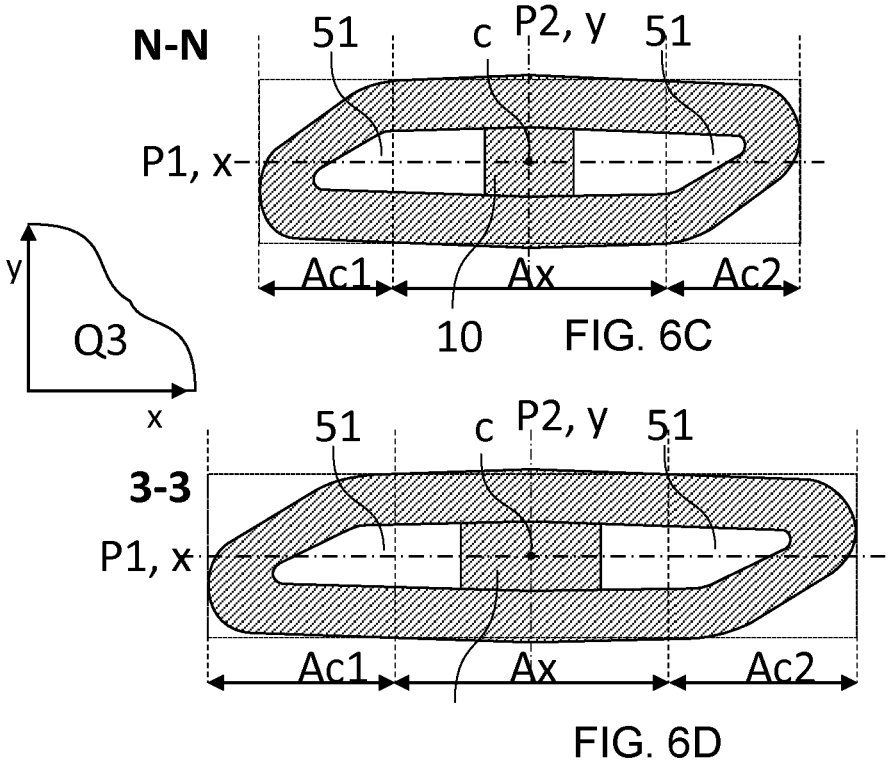
N-N
51
c
P2, y
51
P1, x
Ac1
Ax
Ac2
10
FIG. 6C
y
Q3
x
51
c
P2, y
51
3-3
P1, x
Ac1
Ax
Ac2
FIG. 6D

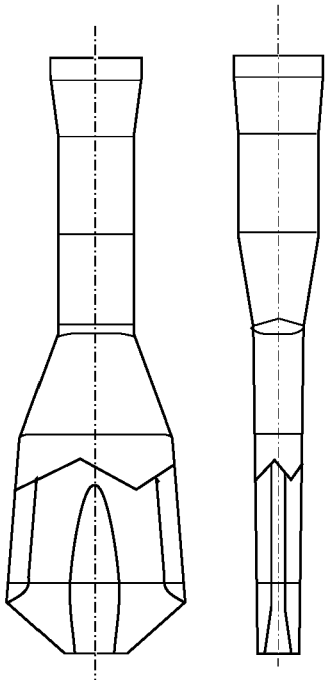
FIG.10
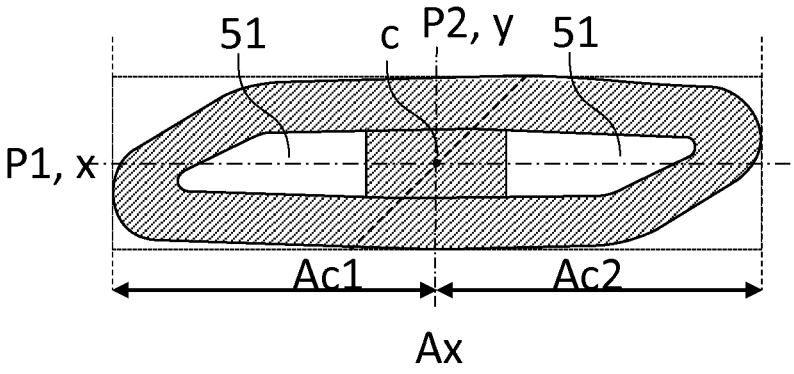
FIG.11 3-3

ASYMMETRIC SLAB NOZZLE AND METALLURGICAL ASSEMBLY FOR CASTING METAL INCLUDING IT

CROSS-REFERENCE TO RELATED APPLICATIONS

This application is a U.S. national stage application, filed under 35 U.S.C. § 371, of International Application No. PCT/EP2018/062420, which was filed on May 14, 2018 and which claims priority to European Application No. EP 17171047.8, filed on May 15, 2017, the contents of which are incorporated by reference into this specification.

BACKGROUND OF THE INVENTION

(1) Field of the Invention

The present invention relates to slab nozzles for casting slabs made of metal. In particular, it concerns slab nozzles having a specific design substantially enhancing their resistance to erosion during the continuous casting operation of slabs.

(2) Description of the Related Art

In continuous metal forming processes, metal melt is transferred from one metallurgical vessel to another, to a mould or to a tool. For example, as shown in FIG. 1 a ladle (not shown) is flied with metal melt out of a furnace and transferred to a tundish (100) through a ladle shroud nozzle. The metal melt can then be cast through a pouring nozzle (1) from the tundish to a mould (110) for forming slabs, billets, beams, thin slabs, or ingots. Flow of metal melt out of the tundish is driven by gravity through the pouring nozzle (1) and the flow rate is controlled by a stopper (7). A stopper (7) is a rod movably mounted above and extending coaxially (i.e., vertically) to a tundish outlet orifice (101) in (vertical) fluid communication with the pouring nozzle. The end of the stopper adjacent to the tundish outlet orifice is the stopper head and has a geometry matching the geometry of said outlet orifice such that when the two are in contact with one another, the tundish outlet orifice is sealed. The flow rate of molten metal out of the tundish and into the mould is controlled by continuously moving up and down the stopper such as to control the space between the stopper head and the nozzle orifice.

Slabs are continuously cast and therefore have an "infinite" length. Their cross-section can have a thickness to width aspect ratio, Tm/Wm; of the order of ¼ or more. Thin slabs are slabs of cross-section having a Tm/WM aspect ratio greater than "conventional" slabs which can have values of ⅛ and greater. Slab mould cavities obviously must reflect similar aspect ratios. Even if the inlet of slab moulds may locally have a funnel-like geometry to admit a downstream portion of a slab nozzle, said downstream portion of the slab nozzle cannot have a geometry of revolution, and must have a thickness to width aspect ratio T/W of at least 1.5 to fit in the cavity inlet of the mould. For thin slab nozzles, the thickness to width aspect ratio T/W must be at least 3.

As illustrated in FIG. 1, as the metal flows out of the outlet ports of the slab nozzle, it does not pour straight down to the downstream end of the mould, but it is retained by the slowly moving metal slab as it is solidifying. The metal melt therefore flows back up and down again forming two vortices extending first away from each other on either side of the slab nozzle following the geometry of the slab mould cavity. As the two vortices reach the lateral walls of the mould cavity, they turn up and back facing each other, flowing one towards the other and meeting in the channels formed on either side of the slab nozzle with the walls of the slab mould cavity. As the two flows meet, strong turbulences are formed in a restricted space, as shown in FIG. 1(*b*). These turbulences in such restricted space are responsible for high erosion rates of the outer wall of the downstream portion of slab nozzles, due to phenomena of cavitation and the like. The service life of slab nozzle is therefore reduced, increasing the production costs accordingly.

DE19505390 describes an immersed casting tube with a long and narrow cross section, having a flattened end section with outlet openings. The passage cross section of the tube within its end region is divided by a distributor into a row of channels. Below the broad pipe walls, as far as down as the exit openings, the channels (9) are open on one side.

WO2013004571, WO9814292, US2002063172, and CN103231048 relate to a submerged entry nozzle for guiding a stream of a metal melt from a tundish into a mould with multiple (three or four) front ports having different orientations and cross-sectional size ratios.

The present invention proposes a slab nozzle having a novel geometry which substantially enhances the service life thereof due to a much lighter and slower erosion of the outer wall of the downstream portion of the slab nozzle. This and other advantages of the present invention are presented in more detail in the following summary and descriptions.

BRIEF SUMMARY OF THE INVENTION

The present invention is defined in the appended independent claims. Preferred embodiments are defined in the dependent claims. In particular, the present invention concerns a slab nozzle for casting slabs made of metal, said slab nozzle having a geometry defined by an outer wall extending over a nozzle length, L, along a longitudinal axis, z, from an upstream end to a downstream end. The outer wall outlines a slab nozzle downstream portion extending along the longitudinal axis, z, from and including the downstream end, wherein

- the upstream end of the slab nozzle comprises an inlet orifice oriented parallel to said longitudinal axis, z, and wherein
- the downstream portion of the slab nozzle comprises the downstream end; said downstream end comprising one or more outlet port orifices, said downstream portion being defined by a width, W, measured along a first transverse axis, x, which is at least 1.5 times, in certain configurations at least three times larger than a thickness, T, of the downstream portion measured along a second transverse axis, y, wherein the first transverse axis, x, is normal to the longitudinal axis, z, and wherein the second transverse axis, y, is normal to both first transverse axis, x, and longitudinal axis.

The slab nozzle further comprises a central bore opening at said inlet orifice, extending therefrom along the longitudinal axis, z, and intersecting the one or more front ports each opening at the one or more outlet port orifices.

The slab nozzle of the present invention is characterized in that, in a cut view or section of the slab nozzle along a transverse plane, P3, and, in certain configurations, in cut views or sections of the slab nozzle along any transverse plane, Pn, the outer wall of the slab nozzle is defined by an outer wall outline which comprises:

a central portion (Ax) wherein the outer wall outline is symmetrical with respect to a central point, c, defined as the intersection point between the longitudinal axis, z, and the transverse plane, P3, and is in certain configurations symmetrical with respect to both first and second transverse axes, x, y, and said central portion being flanked by a first and second lateral portions (Ac1, Ac2), positioned on either side of the central portion (Ax) along the first transverse axis, x, and wherein the outer wall is symmetrical solely with respect to the central point, c, the outer wall outline of the downstream portion is inscribed in a virtual rectangle of first and second edges parallel to the first transverse axis, x, and third and fourth edges parallel to the second transverse axis, y, and wherein a tight distance, dt, of the outer wall outline to first and second diagonally opposed corners of the four corners of the virtual rectangle is at least 1.5 times shorter than a flared distance, df, of the outer wall outline to the other two diagonally opposed corners of the virtual rectangle, wherein the distance of the outer wall outline to a corner is defined as the distance between said corner and a point of the outline located closest to said corner.

The system of axes, x, y, z, forms a coordinates system defining reference planes, Q1=(x, z), Q2=(y, z), and Q3=(x, y). The transverse plane, P3, is the plane normal to the longitudinal axis, z, and intersecting the one or more outlet port orifices, that produces the maximum distance L3 between the transverse plane, P3, and the downstream end. A transverse plane, Pn, is a plane normal to the longitudinal axis, z, and intersecting the longitudinal axis, z, at a distance, Ln, to the downstream end of not more than 60% of the nozzle length, L, preferably not more than 50% of L. All transverse planes, Pn, are parallel to the reference plane, Q3, and the transverse plane, P3, is a specific transverse plane, Pn.

In a particular configuration, in the cut view or section along a transverse plane, Pn, and, in particular, along the transverse plane, P3, the outer wall outline of the downstream portion is inscribed in a virtual rectangle of first and second edges parallel to the first transverse axis, x, and third and fourth edges parallel to the second transverse axis, y. The tight distance, dt, can be at least twice, or at least three times shorter than a flared distance, df, of the outer wall outline to the other two diagonally opposed corners of the virtual rectangle (2 dt≤df). The distance of the outer wall outline to a corner is defined as the distance between said corner and a point of the outline located closest to said corner. The tight distance, dt, may be not more than ten times, or not more than eight times shorter than the flared distance, df.

Another way of defining the geometry of the slab nozzle outline is by defining, on the one hand, a first and second tight areas, At, comprised between the outer wall outline and the edges of the virtual rectangle joining at the first and second diagonally opposed corners, respectively and, on the other hand, a first and second flared areas, Af, each of a first and second tight areas, At, comprised between the outer wall outline and the edges of the virtual rectangle joining at the other two diagonally opposed corners. The first and second tight area, At, each has an area of not more than 80%, or not more than 67%, or not more than 50% of an area of the first and second flared areas, At, (5 At ≤4 At).

With a slab nozzle according to the present invention and, in particular, having the foregoing geometries defined by tight and flared distances and/or by tight and flared areas, a stream of molten metal flowing towards the slab nozzle in a direction normal to the reference plane, Q2, will preferably flow through the gap formed between the slab nozzle and the slab mould which is on the side of the flared distance, df, and/or of the flared area, Af, and will be restricted on the side of the tight distance, dt, and/or of the tight area, At, thus creating a round-about effect, with two streams flowing in opposite directions on two opposite sides of the slab nozzle, thus avoiding any collision between the two streams within one such gap.

The central portion (Ax) of the outer wall outline may extend over at least 33%, or at least 50% of the width, W, of the first and second edges of the virtual rectangle, and may extend not more than 85%, or not more than 67% of the width, W, of the first and second edges of the virtual rectangle (33% W≤Ax≤85% W).

Protrusions can be distributed on the outer wall of the downstream portion of the slab nozzle. Protrusions allow the dissipation of the kinetic energy of a metal stream flowing through a gap. To further enhance the round-about effect, the protrusions are arranged on a first and second hindered portions of the outer wall of the downstream portion, said first and second hindered portions, corresponding to the portion of the outer wall outline in the cut along a plane, Pn, or, in particular, along the plane, P3, which is contained in the two diagonally opposed quarters of the virtual rectangle including the tight distance, dt, or the tight area, At.

The protrusions can have a multitude of geometries. For example, the protrusions may be in the form of circles, ellipses, straight or curved lines, chevrons, arcs of circles, polygons. The protrusions may protrude out of the surface of the outer wall of the downstream portion by at least 3 mm, or at least 4 mm, and may protrude by not more than 20 mm, or not more than 15 mm. If the protrusions are discrete protrusions, they may be distributed in a staggered arrangement on the outer wall of downstream portion of the slab nozzle, such as on the first and second hindered portions thereof.

The one or more front ports may flare out as they open at the corresponding outlet port orifices. A nozzle according to the present invention may contain a first and second front ports which open at a corresponding first and second outlet port orifices. The first and second front ports may be separated from one another by a divider extending in the central bore from the downstream end along the longitudinal axis, z, and dividing the bore into the first and second front ports. In a cut view or section of the thin slab nozzle along a transverse nozzle, Pn, and, in particular, along the transverse plane, P3, the first and second front ports may be defined by a first and second front ports outlines each comprising a lateral portion remote from the divider which is symmetrical solely with respect to the central point, c, and is may be substantially parallel to the corresponding first and second lateral portions (Ac1, Ac2) of the outer wall outline.

The present invention also concerns a metallurgic assembly for casting metal slabs, said metallurgic assembly comprising:

a metallurgic vessel comprising a bottom floor provided with an outlet, a slab mould extending along a longitudinal axis, z, defined by a width, W, measured along a first transverse axis, x, and by a thickness, Tm, measured along a second transverse axis, y, wherein x⊥y⊥z, and comprising a mould cavity defined by cavity walls and opening at an upstream end of the cavity, and a slab nozzle according to any one of the preceding claims, wherein the upstream end of the slab nozzle is coupled to the bottom floor of the metallurgic vessel such that the outlet (101) is in fluid communication with the inlet orifice (50*u*), and wherein the downstream portion of the slab nozzle is inserted in the cavity of the slab mould over an inserted length, Li, measured between the upstream end of the mould cavity and the downstream end of the slab nozzle, and in alignment with the longitudinal axis, z, and the first and second transverse axes, x, y.

A section of the metallurgic assembly along a transverse plane, Pm, and, in particular, along the transverse plane, P3, may comprise:

a first tight gap between the cavity wall outline and the first lateral portions (Ac1) of the outer wall outline having a first tight gap width, Gt1, measured at a first side of the first transverse axis, x, along a segment, m, parallel to the second transverse axis, y, and passing by an intersection point between the first lateral portions (Ac1) of the outer wall outline and the first transverse axis, x, which is not more than half, or not more than a third of a first flared gap width, Gf1, of a first flared gap between the cavity wall outline and the first lateral portions (Ac1) of the outer wall outline measured at a second side of the first transverse axis, x, along the segment, m, (2 Gt1≤Gf1), wherein a second tight gap between the cavity wall outline and the second lateral portions (Ac2) of the outer wall outline having a second tight gap width, Gt2, measured at the second side of the first transverse axis, x, along a segment, n, parallel to the second transverse axis, y, and passing by an intersection point between the second lateral portions (Ac2) of the outer wall outline and the first transverse axis, x, which is not more than half, or not more than a third of a second flared gap width, Gf2, of a second flared gap between the cavity wall outline and the second lateral portions (Ac2) of the outer wall outline measured at the first side of the first transverse axis, x, along the segment, n, (2 Gt2≤Gf2), the first tight width, Gt1, is substantially equal to the second tight gap width, Gt2, (Gt1=Gt2), and Gt1 and Gt2 may be comprised between 10 and 70% of a maximum thickness of the outer wall outline of the slab nozzle measured along the second transverse axis, y; and the first flared gap width, Gf1, is substantially equal to the second flared gap width, Gf2, (Gf1=Gf2).

A transverse plane, Pm, Is a plane normal to the longitudinal axis, z, and intersecting the downstream portion of the nozzle slab, over at least 40%, preferably at least 50%, more preferably at least 75% of the inserted length, U. The transverse plane, P3, is a specific transverse plane, Pm, and are all parallel to the reference plane, Q3.

In the same cut view or section of the metallurgic assembly along a transverse plane, Pm, and, in particular, along the transverse plane, P3, the cavity of the slab mould is defined by a cavity wall outline which comprises, a first and second cavity lateral portions having a lateral cavity thickness, Tmc, which is substantially constant, said first and second cavity lateral portions being aligned over the first transverse axis, x, and flanking on either side, a central cavity portion, having a central cavity width, Wmx, wherein the cavity wall outline is symmetrical with respect to both first and second transverse axes, x, y, having a thickness equal to Tmc on either side where it joins the first and second lateral portions, and evolving smoothly until reaching a maximum cavity thickness value, Tmx, at the intersection points between the cavity wall outline and the second transverse axis, y, and wherein Tmx can be same as or different from Tmc, (Tmx=Tmc or Tmx≠Tmc), and the outer wall outline of the slab nozzle:

has a nozzle width, W, measured along the first transverse direction, x, which is smaller than the central cavity width, Wmx, has a nozzle thickness, T, measured along the second transverse axis, y, having a maximum value, Tx, and wherein, the thickness ratio, Tmx/Tx, of the slab mould to the slab nozzle is comprised between 1.2 and 2.7, preferably between 1.5 and 2.1.

BRIEF DESCRIPTION OF THE DRAWINGS

For a fuller understanding of the nature of the present invention, reference is made to the following detailed description taken in conjunction with the accompanying drawings in which:

FIG. 5 shows different views along planes, Q1, Q2, and P3, of a thin slab nozzle according to the present invention, with various dimensions, with two alternative geometries of the downstream portion on a cut along plane, P3.

FIG. 6 shows different views along planes, Q1, Q2, and two parallel planes Pn and P3, of a slab nozzle according to the present invention, with various dimensions.

FIG. 10 shows a slab nozzle according to the present invention provided with a divider separating a first and second outlet ports.

FIG. 11 shows a cut view or section along plane P3 of a slab nozzle according to the present invention.

DETAILED DESCRIPTION OF THE INVENTION

Figure 1A:
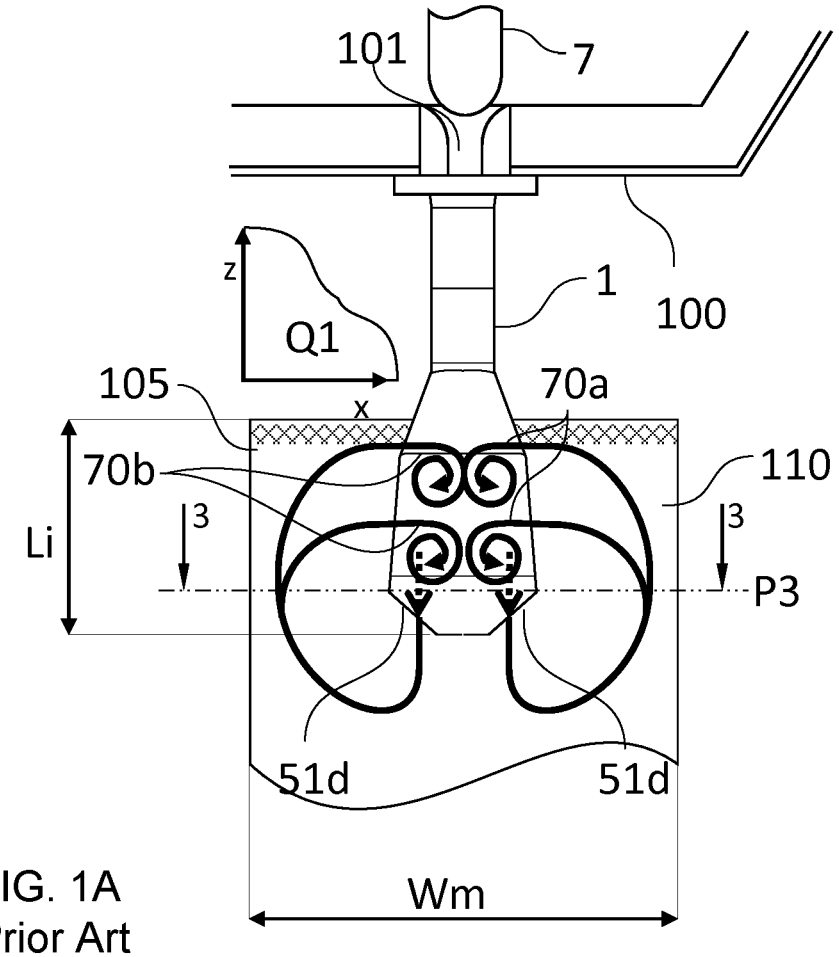
FIG. 1A Prior Art
FIG. 1 shows a slab nozzle of the prior art coupled to a tundish and partially inserted in a mould; the black arrows show the main flow path followed by the metal melt flowing into the mould (a) front view, (b) cut view or section along 3-3 (=plane P3) which is normal to the longitudinal axis, z, of the nozzle.

FIGS. 4 and 5 show embodiments of a slab nozzle according to the present invention. The slab nozzle has a geometry defined by an outer wall extending over a nozzle length, L, along a longitudinal axis, z, from an upstream end (42*u*) to a downstream end (42*d*). The upstream end (42*u*) of the slab nozzle comprises an inlet orifice (50*u*) oriented parallel to said longitudinal axis, z.

The outer wall outlines a slab nozzle downstream portion (46*d*) extending along the longitudinal axis, z, from and including the downstream end (42*d*), and comprises one or more outlet port orifices (51*d*). A slab nozzle generally comprises at least a first and second front ports (51) opening at a corresponding first and second outlet port orifices. The first and second front ports may be separated from one another by a divider (10) extending in the central bore from the downstream end along the longitudinal axis, z, as shown in FIG. 10. A slab nozzle may also comprise a front port parallel and generally coaxial with the longitudinal axis, z (not shown). In a preferred embodiment, the one or more front ports flare out as they open at the first and second outlet port orifices, as shown in FIG. 10.

The downstream portion is defined by a width, W, measured along a first transverse axis, x, which is at least 1.5 times larger than a maximum thickness, Tx, of the downstream portion measured along a second transverse axis, y, wherein the first transverse axis, x, is normal to the longitudinal axis, z, and wherein the second transverse axis, y, is normal to both first transverse axis, x, and longitudinal axis, z. This W/Tx aspect ratio is required for inserting the downstream portion of the slab nozzle into the cavity of a slab mould, which is, of course, much wider than it is thick. For so-called thin slab nozzles, the WI Tx aspect ratio is at least 3, preferably at least 4 or 5.

The slab nozzle further comprises a central bore (50) opening at said inlet orifice (50*u*), extending therefrom along the longitudinal axis, z, and intersecting the one or more front ports (51) each opening at the one or more outlet port orifices. When the upstream end of the slab nozzle is coupled to the bottom floor of a metallurgic vessel (100), such as a tundish, the central bore of the slab nozzle is aligned and in fluid communication with an outlet (101) provided at the bottom floor of the tundish, such that the metal melt can flow out of the tundish through the outlet and through the central bore and flow out of the slab nozzle through the outlet port orifices.

The downstream portion of the slab nozzle is inserted in a cavity (110*c*) of a slab mould. The slab mould cavity has a width, Wm, measured along the first transverse axis, x, and a thickness, Tm, measured along the second transverse axis, y, which is constant for rectangular cavities (cf. FIG. 8(*b*)), and wherein Wm is at least four times larger than Tm, (Wm≥4 Tm), and even at least eight times larger than Tm, (Wm≥4 Tm) for thin slab moulds. A lubricant is added to the metal in the slab mould to prevent sticking, and to trap any slag particles that may be present in the metal and bring them to the top of the pool to form a floating layer of slag (105). The shroud is set so the hot metal exits it below the surface of the slag layer in the mold and is thus called a submerged entry nozzle (SEN).

Figure 1B:
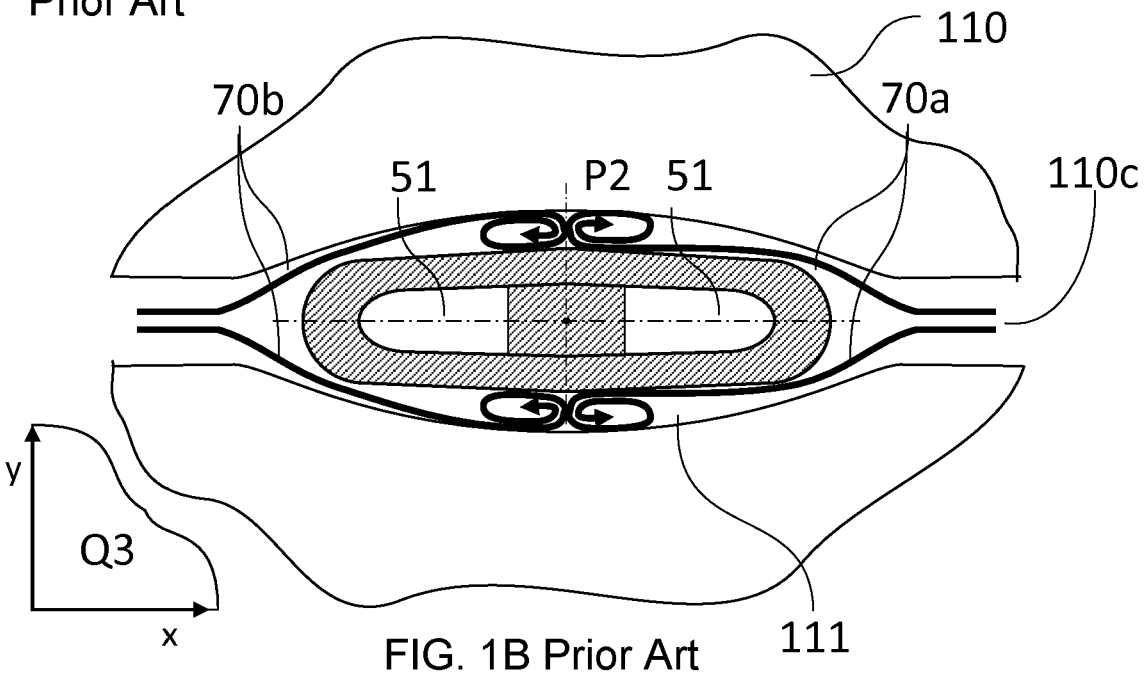
FIG. 1B Prior Art
Figure 2A:
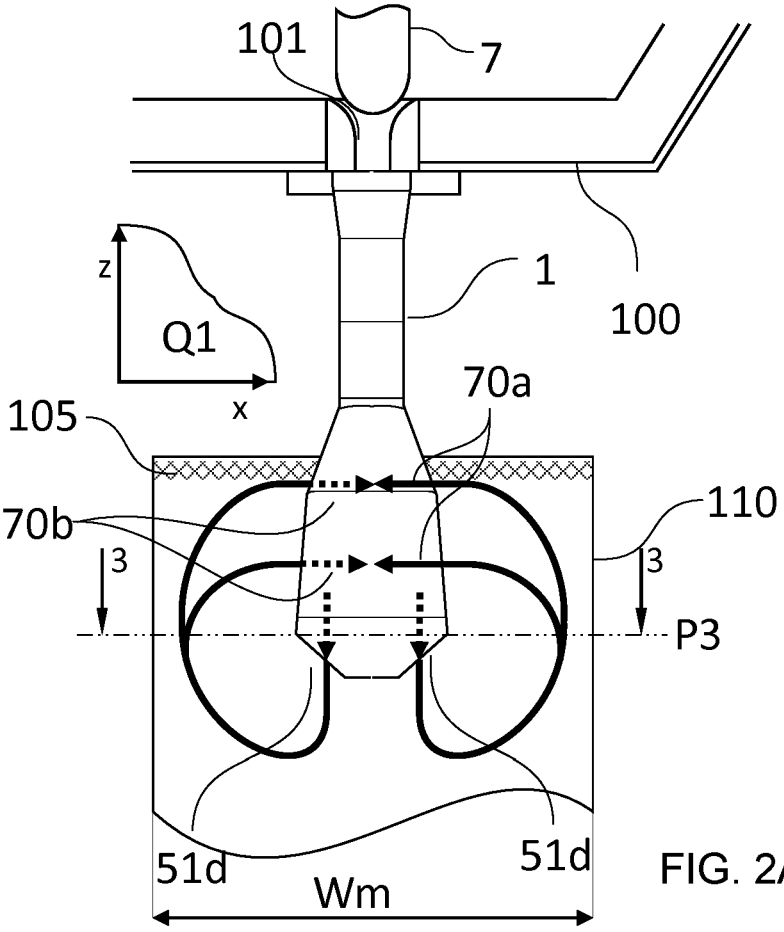
FIG. 2 shows a slab nozzle according to the present invention coupled to a tundish and partially inserted in a mould; the black arrows show the main flow path followed by the metal melt flowing into the mould (a) front view, (b) cut view or section along 3-3 (=plane P3) which is normal to the longitudinal axis, z, of the nozzle.
Figure 2B:
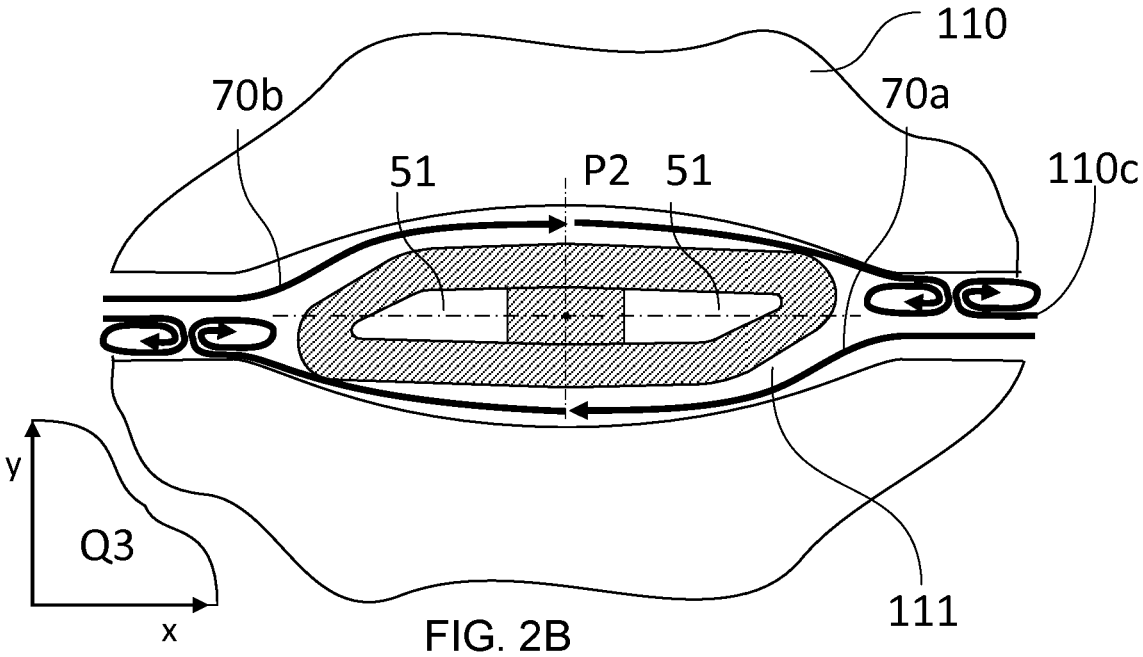

As illustrated in FIGS. 1 and 2, metal melt flowing out of the outlet ports of a slab nozzle follows a loop path along the width, Wm, of the mould cavity, at two opposite sides of the longitudinal axis, z. The flow path is constrained at the bottom by metal flowing at a lower rate as it solidifies in the slab mould cavity and is therefore split in two diverging flows which are deviated sideways. The slab mould cavity being so thin, that the flow cannot be deviated substantially into the second transverse axis, y, direction, and it must flow along the first transverse axis, x, direction on either side of the longitudinal axis, z, until it reaches the side walls at the corresponding sides of the cavity. At this stage, the flows are deviated upwards until they are constrained by the floating layer of slag at the top of the pool. The metal is then deviated inwards into converging streams flowing one towards the other on either side of the slab nozzle. When the two converging flows reach the slab nozzle, each is split into two streams (70*a*, 70*b*) flowing on either side of the outer wall of the downstream portion of the slab nozzle, that the flows see like the leading edge of a wing. If two streams (70*a*, 70*b*) of molten metal flowing in opposite converging directions meet in the narrow channels (111) formed between the mould cavity wall and the outer wall on either side of the slab nozzle meet, strong turbulences would form. As discussed supra, these turbulences substantially accelerate the erosion of the slab nozzle and are detrimental to the service life thereof.

The outer wall of a slab nozzle as seen by a stream of metal flowing towards the slab nozzle at the level of the outlet ports can be characterized by an outer wall outline of a cut view or section along a transverse plane, P3, wherein the transverse plane, P3, is the plane normal to the longitudinal axis, z, and intersecting the one or more outlet port orifices, that produces the maximum distance L3 between the transverse plane, P3, and the downstream end. Transverse plane P3 is therefore parallel to plane Q3=(x, y).

In conventional slab nozzles, as illustrated in FIG. 1(*b*), the downstream portion is generally symmetrical at least with respect to the plane, Q1=(x,z), and with respect to the plane, Q2=(y,z). The outer wall outline of the corresponding cut view or section along the plane, P3, is therefore symmetrical at least with respect to the first transverse axis, x, and with respect to the second transverse axis, y. A flow of metal melt meeting the symmetrical leading edge formed by one lateral profile of such slab nozzle would therefore split into two streams (70*a*, 70*b*) of substantially identical flowrates flowing in substantially identical channels formed on either side of the slab nozzle with the mould cavity wall. The same of course happens with the molten metal flowing towards the second, opposite lateral profile of the slab nozzle. On each channel (111) formed on either side of the slab nozzle and the mould cavity wall, two streams flowing in opposite directions meet at about the middle section of the slab nozzle, i.e., at about the position of plane, Q2=(y,z). Strong turbulences are formed in a very restricted space, eroding the outer wall of the slab nozzle.

The gist of the present invention is to prevent two streams (70*a*, 70*b*) of molten metal from colliding in the narrow channels (111) formed on either side of a slab nozzle with the mould cavity wall. The principle is to create a round-about around the slab nozzle such that, like cars on a road, each opposite stream (70*a*, 70*b*) flows through its own channel (111) on one side only of the slab nozzle. As shown in FIG. 2(*b*), the stream (70*a*) flowing from right to left, is forced to flow left of the slab nozzle, through the lower channel (111) illustrated in the Figure. Similarly, the stream (70*b*) flowing from left to right, is forced to flow left of the slab nozzle, through the upper channel (111) illustrated in the Figure. The two streams (70*a*, 70*b*) therefore do not meet and collide in the channels (111), but downstream of the channels, away from the outer wall of the slab nozzle, where there is more room to expand and to dissipate energy thus creating less damages to the equipment. The "round-about" effect is obtained by selecting the geometry of the downstream portion of the slab nozzle as follows.

Figure 3:
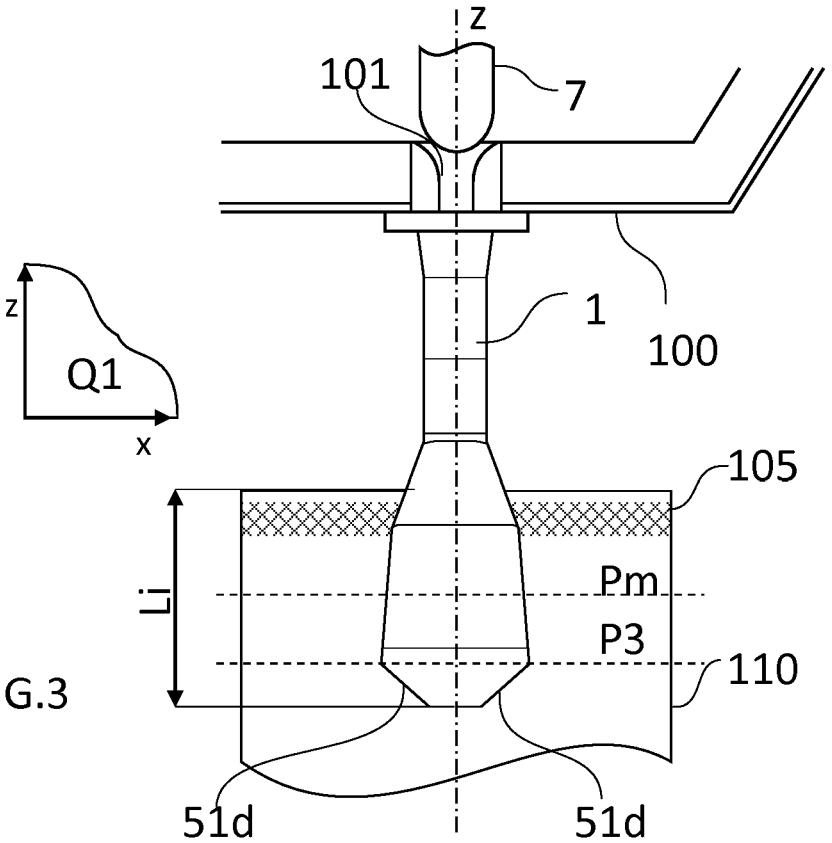
FIG. 3 shows a slab nozzle according to the present invention coupled to a tundish and partially inserted in a mould, with various dimensions and cut planes Pm and P3.
Figure 4A:
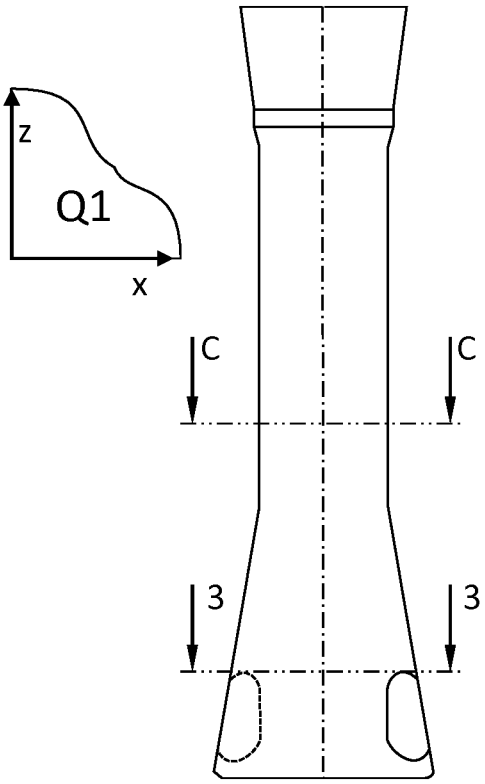
FIG. 4 shows different views along planes, Q1=(x,z), Q2=(y,z), and P3 (‖Q3=(x,y)) of a slab nozzle according to the present invention, with various dimensions.
Figure 4B:
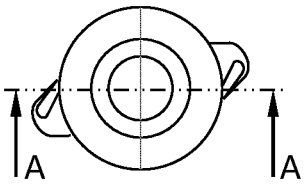
Figure 4C:
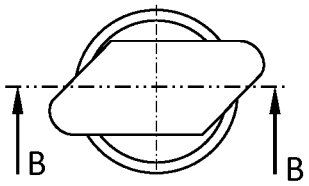
Figure 4H:
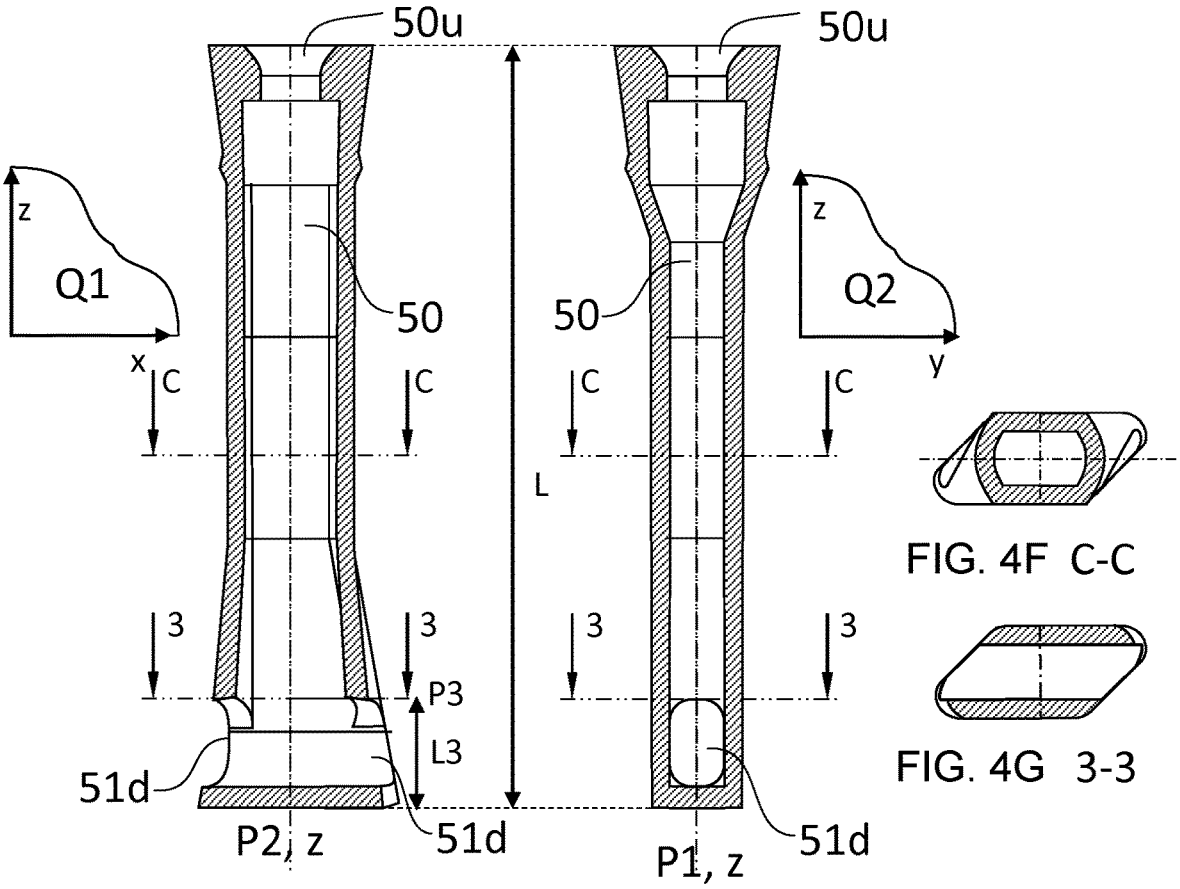
Figure 4H:
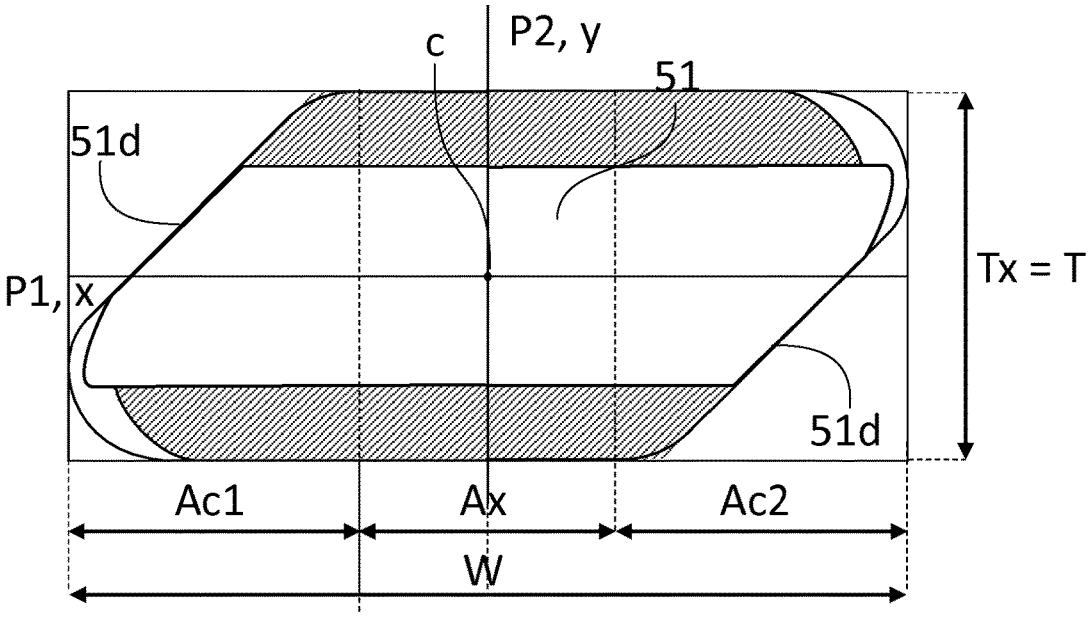

As illustrated in FIGS. 4(*h*), 5(*c*)&(*d*), and 11, the cut view or section of the slab nozzle along the transverse plane, P3, the outer wall outline of the outer wall of the slab nozzle comprises:

a central portion (Ax) wherein the outer wall outline is symmetrical with respect to a central point, c, defined as the intersection point between the longitudinal axis, z, and the transverse plane, P3, and said central portion being flanked by a first and second lateral portions (Ac1, Ac2), positioned on either side of the central portion (Ax) along the first transverse axis, x, and wherein the outer wall is symmetrical solely with respect to the central point, c, It is important that the outer wall outline comprises lateral portions (Ac1, Ac2) having no axial symmetry with respect to the first transverse axis, x, in order to favour the flow of a stream of molten metal along one side of the outer wall of the slab nozzle, and to hinder the flow over the opposite side with respect to the axis, x. In one embodiment illustrated in FIG. 11, the outer wall outline in the central portion (Ax), like in the first and second lateral portions, Is symmetrical solely with respect to the central point, c. In this case, the central portion (Ax) is geometrically reduced to the second transverse axis, y, and in practice, disappears. It is preferred, however, that as illustrated in FIGS. 3(*h*) and 4(*c*)&(*d*), the outer wall outline in the central portion (Ax) is symmetrical with respect to the first and/or second transverse axes, x, y, preferably with respect to both axes, x and y. For example, the central portion (Ax) of the outer wall outline may extend over at least 33%, or at least 50% of the width, W, of the slab nozzle downstream portion. The central portion (Ax) may extend not more than 85%, or may extend not more than 67% of the lengths of the first and second edges of the virtual rectangle (33% W≤Ax≤85% W).

In order to keep the outer wall thickness substantially constant, it is preferred that, in the cut view or section of the thin slab nozzle along the transverse plane, P3, the first and second front ports are defined by a first and second front ports outlines each comprising a lateral portion remote from the divider which is symmetrical solely with respect to the central point, c, and may be substantially parallel to the corresponding first and second lateral portions (Ac1, Ac2) of the outer wall outline. In other words, it is advantageous that the same asymmetry be applied to the geometry of the front ports as to the outer wall, such that the nozzle wall has a substantially constant thickness. This way there is no risk of having a weak spot wherein the wall is too thin, or of wasting refractory material by unnecessarily locally increasing the thickness of the outer wall.

In the embodiment illustrated in FIG. 6, in cut views or sections of the slab-nozzle along any transverse plane, Pn, the outer wall of the slab nozzle is defined by an outer wall outline which comprises a central portion and a first and second lateral portions as defined supra with respect to the transverse plane, P3. A transverse plane, Pn, is a plane normal to the longitudinal axis, z, and intersecting the longitudinal axis, z, at a distance, Ln, to the downstream end of not more than 60% of the nozzle length, L, or not more than 50% of L, or not more than 40% of L. The distance, Ln, is at least 1% of L, or at least 2% of L, or at least 5% of L. The transverse plane, P3, is one example of a transverse plane, Pn.

In a cut view or section along the transverse plane, P3, and advantageously along any transverse plane, Pn, the outer wall outline of the downstream portion is inscribed in a virtual rectangle of first and second edges parallel to the first transverse axis, x, and third and fourth edges parallel to the second transverse axis, y.

Figure 7A:
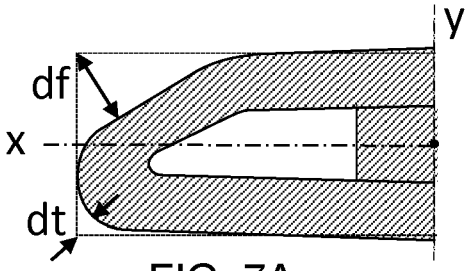
FIG. 7 shows two cut views or sections along a plane P3 defining the geometry of the outer wall outline of a slab nozzle according to the present invention.
Figure 7B:
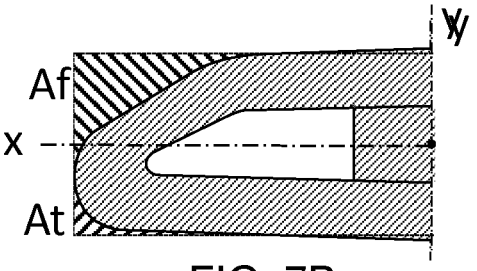

According to the embodiment illustrated in FIG. 7(*a*), the "round-about" effect is obtained by ensuring that a tight distance, dt, of the outer wall outline to first and second diagonally opposed corners of the four corners of the virtual rectangle is at least 1.5 times, or at least twice (i.e., 2 dt≤df), or at least three times (i.e., 3 dt≤df) shorter than the flared distance, df, of the outer wall outline to the other two diagonally opposed corners of the virtual rectangle, wherein a distance of the outer wall outline to a corner is defined as the distance between said corner and a point of the outline located closest to said corner. For example, the distances dt and df can be 14 mm and 42 mm, respectively, yielding a ratio df/dt=3 or, alternatively the distances dt and df can be 15 and 38, respectively, yielding a ratio df df/dt=2.5. With such geometry, the channel (or "strait" using nautical terms) formed between the outer wall of the slab nozzle and the mould cavity wall is broader on the side of flared distance, df, defining a "flowing side" of the slab nozzle forming the broad side of a funnel where the molten metal can flow more easily than on the side of tight distance, dt, defining a "hindered side" of the slab nozzle and forming the tight side of the funnel, where flow is hindered.

Alternatively, or concomitantly, as illustrated in FIG. 7(*b*), each of a first and second tight areas, At, comprised between the outer wall outline and the edges of the virtual rectangle joining at the first and second diagonally opposed corners, respectively has an area of not more than 80% (i.e., 5 At≤4 Af), or not more than 67% (i.e., 3 At≤2 Af), or not more than 50% (i.e., 2 At ≤Af) of an area of a first and second flared areas, Af, comprised between the outer wall outline and the edges of the virtual rectangle joining at the other two diagonally opposed corners. Again, the flow of a molten metal stream is favoured on the side of the slab nozzle wherein the area, Af, defines the broad side of a funnel, compared with the side of area, At, defining the tight side of a funnel, where flow is hindered.

As discussed supra, the round-about effect is obtained by forcing a stream of molten metal flowing towards a lateral profile of the slab nozzle to be deviated preferentially to a flowing side of the slab nozzle, rather than to the opposite, hindered side of the slab nozzle. This is achieved by facilitating flow through the flowing side of the slab nozzle by forming a broad funnel entrance at the flowing side and forming a narrow side of the funnel at the hindered side. By applying this geometry with a central symmetry at both lateral profiles of the slab nozzles, facing opposite flows of metal melt, each stream is deviated towards its own one-way street at one side of the slab nozzle (cf. FIG. 2(*b*)). Unlike cars, molten metal cannot be prevented from flowing the wrong way with a traffic sign. As illustrated in FIG. 9, a stream of molten metal can further be hindered from flowing down the wrong way of the hindered side of the slab nozzle by providing a number of protrusions jutting out of the outer wall of the downstream portion of the slab. Said protrusions are preferably distributed over an area of the outer wall comprised within the two diagonally opposed quarters of the virtual rectangle (i.e., intersecting at the central point, c, only) containing the hindered sides of the slab nozzle outer wall outline, which can be characterized by the tight distance, dt, or by the tight area, At.

As shown in FIG. 9(*b*) to (*j*), the protrusions (5) may have different geometries, including circles and ellipses (cf. FIG. 9(*b*)), straight or curved lines, which can be continuous or discontinuous (cf. FIG. 9(*h*)&(*g*)), chevrons (cf. FIG. 9(*d*)

&(*e*)), arcs of circles (cf. FIG. 9(*d*)&(*f*)), polygons (not shown), and the like. The protrusions may protrude out of the surface of the outer wall of the downstream portion by at least 3 mm, or at least 4 mm, and may protrude by not more than 20 mm, or not more than 15 mm. The protrusions can be continuous lines, as shown in FIG. 9(*g*) to (*j*), or discrete protrusions, as shown in FIG. 9(*a*)-(*f*). Discrete protrusions are preferably distributed in a staggered arrangement on the first and second hindered portions of the outer wall of the downstream portion. Protrusions as illustrated in FIG. 9(*e*)&(*f*) comprising a concave side facing the stream to be hindered from flowing are particularly effective for promoting the round-about effect sought in the present invention.

The slab nozzle of the present invention is used in a metallurgic assembly for casting metal slabs as illustrated in FIG. 2. Said metallurgic assembly comprises:

- a metallurgic vessel (100) comprising a bottom floor provided with an outlet (101),
- a slab mould (110) comprising a cavity (110*c*) defined by cavity walls and opening at an upstream end of the cavity, and
- a slab nozzle as described before, wherein the upstream end of the slab nozzle is coupled to the bottom floor of the metallurgic vessel such that the outlet (101) is in fluid communication with the inlet orifice (50*u*) of the slab nozzle, and wherein the downstream portion of the slab nozzle is inserted in the cavity of the slab mould over an insertion length, Li, measured along the longitudinal axis, z, from the upstream end of the mould cavity, and in alignment with the longitudinal axis, z, and the first and second transverse axes, x, y.

The cavity of the slab mould is defined by cavity walls extending along the longitudinal axis, z. In a cut view or section of the metallurgic assembly along the transverse plane, P3, the cavity wall is defined by a cavity wall outline 36 illustrated in FIG. 8. The cavity wall outline comprises:

- a first and second cavity lateral portions having a lateral cavity thickness, Tmc, which is substantially constant, said first and second cavity lateral portions being aligned over the first transverse axis, x, and flanking on either side,
- a central cavity portion, having a central cavity width, Wmx, a thickness equal to Tmc on either side where it joins the first and second lateral portions, and evolving smoothly until reaching a maximum cavity thickness value, Tmx, at the intersection points between the cavity wall outline and the second transverse axis, y, and wherein Tmx can be same as or greater than Tmc, (Tmx≥Tmc).

Figure 8A:
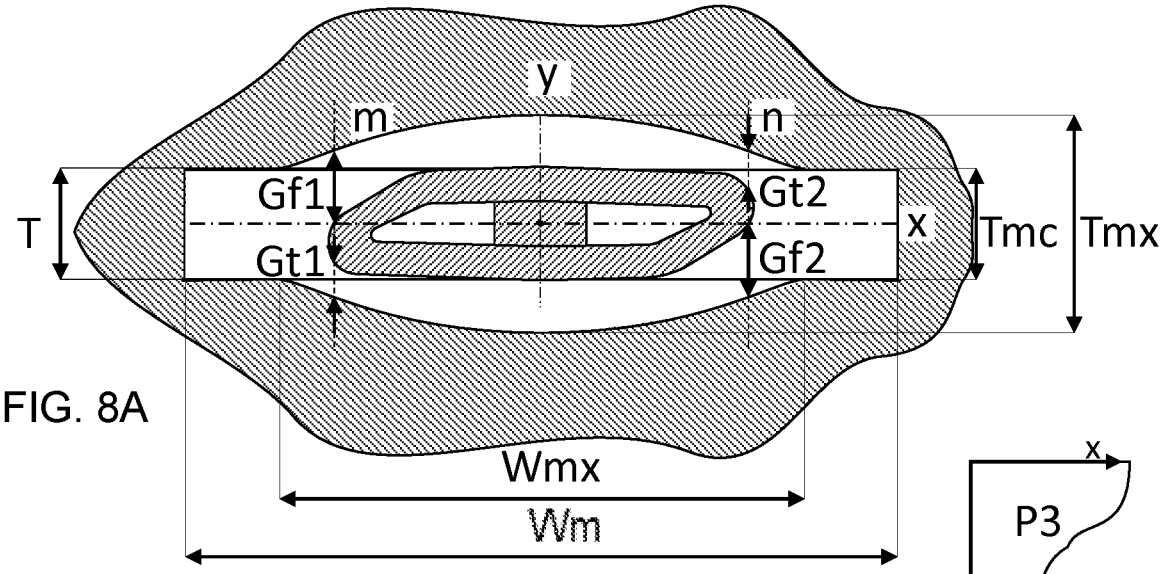
FIG. 8 shows cut views or sections along a plane P3 of a slab nozzle inserted in two different slab moulds.
Figure 8B:
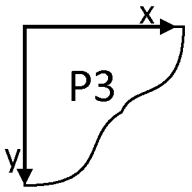
Figure 8B:
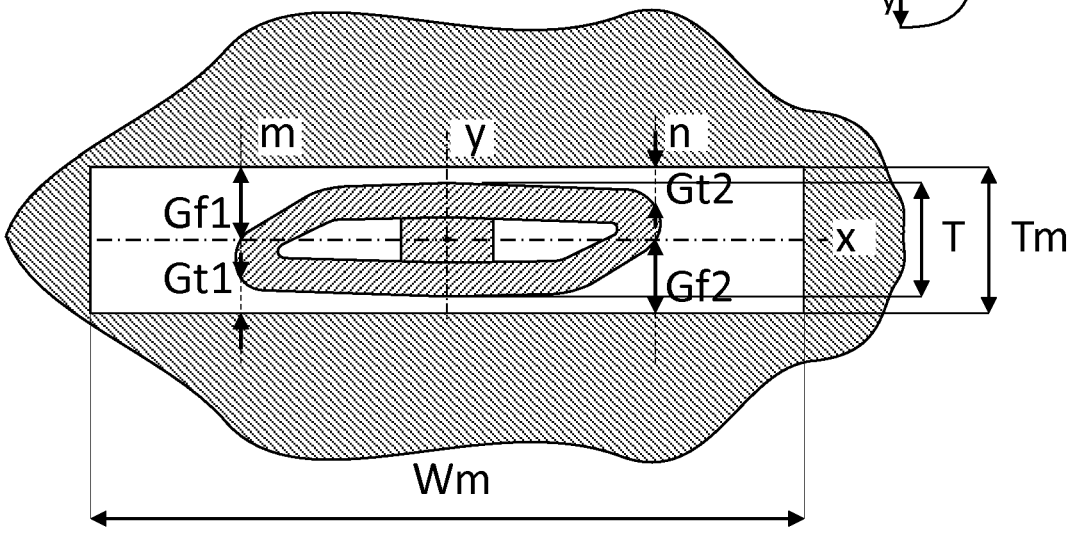
Figure 9A:
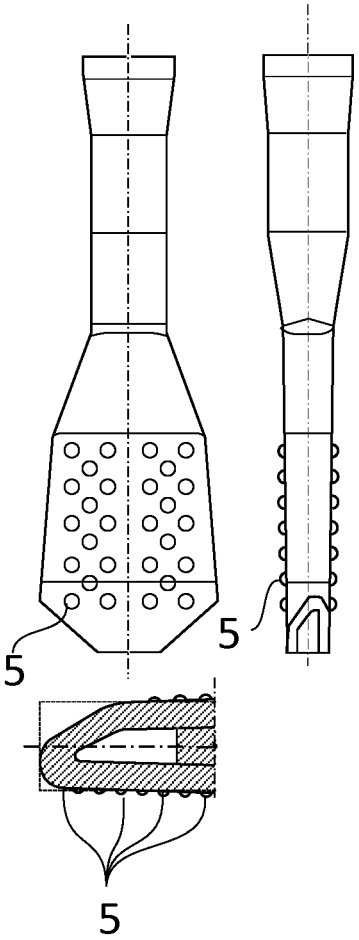
FIG. 9 shows a slab nozzle according to the present invention provided with protrusions on parts of the outer wall, with various protrusions geometries represented at (b)-(j).
Figure 9B:
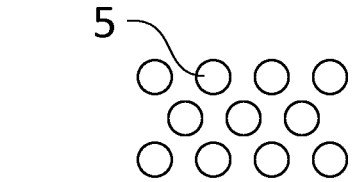
Figure 9C:
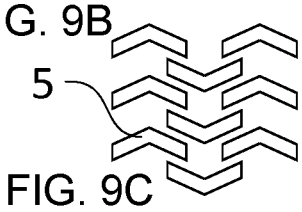
Figure 9D:
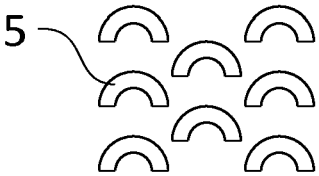
Figure 9E:
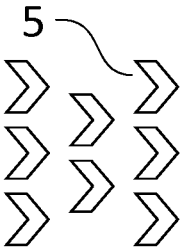
Figure 9F:
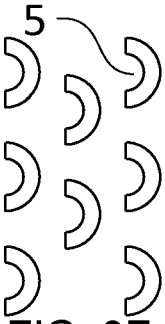
Figure 9G:
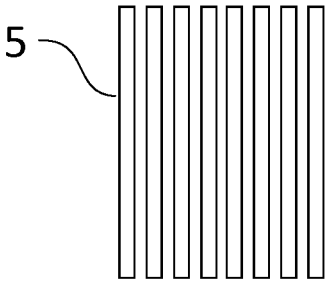
Figure 9H:
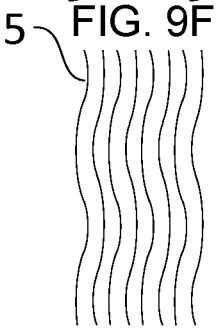
Figure 9I:
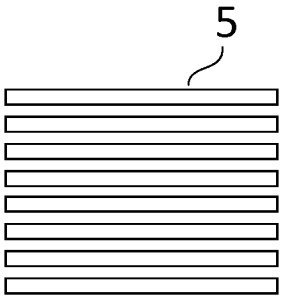
Figure 9J:
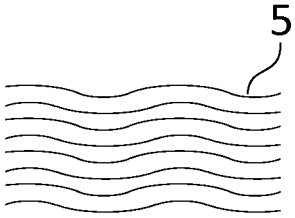

In one embodiment, Tmx=Tmc, defining a rectangular cavity wall outline, as shown in FIG. 8(*b*). In other terms, this embodiment can also be defined as having a central portion of width, Wmx=0.

In cases where the slab to be cast has a thickness substantially lower than the thickness, T, of the slab nozzle, the mould cavity may include a funnel shaped portion allowing the insertion of the downstream portion of the slab nozzle. This embodiment is illustrated in FIG. 8(*a*), wherein the thickness of the mould cavity wall outline in the central portion gradually increases compared with the lateral portions until reaching the maximum cavity thickness value, Tmx>Tmc. This funnel shaped central portion of the cavity wall ends in the z-direction below the downstream end of the slab nozzle, at which point, the mould cavity has a rectangular cross-section. The cross-sections normal to the longitudinal axis, z, of the funnel shaped central portion preferably have a cavity wall outline which is symmetrical with respect to both first and second transverse axes, x, y. The width, Wmx, of the cavity wall central portion measured along the x-direction must be larger than the width, W, of the slab nozzle. Similarly, the maximum cavity thickness value, Tmx, measured along the y-direction must be larger than the maximum thickness, Tx, of the slab nozzle. In a particular embodiment, the thickness ratio, Tmx/Tx, of the slab mould to the slab nozzle is comprised between 1.2 and 2.7, or between 1.5 and 2.1.

A shown in FIGS. 2(*b*) and 8, channels or gaps are formed between the slab nozzle outer wall and the cavity wall on either side of the first transverse axis, x. The streams of molten metal flow substantially parallel to the first transverse axis, x, in opposite converging directions towards the second transverse axis, y. The round-about effect illustrated in FIG. 2(*b*), wherein each stream preferentially flows along its own channel at one side of the first longitudinal axis, x, is obtained by controlling the respective widths, Gt and Gf, of the channels entries at the hindered and flowing sides of the slab nozzle, respectively. Accordingly, as illustrated in FIG. 8, in a cut view or section of the metallurgic assembly along the transverse plane, P3, the channels or gaps can be defined as explained below.

In a first side of the second transverse axis, y, there is a first tight gap between the cavity wall outline and the first lateral portions (Ac1) of the outer wall outline having a first tight gap width, Gt1, measured at a first side of the first transverse axis, x, along a segment, m, parallel to the second transverse axis, y, and passing by an intersection point between the first lateral portions (Ac1) of the outer wall outline and the first transverse axis, x. The first tight gap width, Gt1, is not more than half, or not more than a third of a first flared gap width, Gf1, of a first flared gap between the cavity wall outline and the first lateral portions (Ac1) of the outer wall outline measured at a second side of the first transverse axis, x, along the segment, m, (2 Gt1≤Gf1), In a second, opposite side of the second transverse axis, y, there is a second tight gap between the cavity wall outline and the second lateral portions (Ac2) of the outer wall outline which is diagonally opposite to the first tight gap. The second tight gap has a second tight gap width, Gt2, measured at the second side of the first transverse axis, x, along a segment, n, parallel to the second transverse axis, y, and passing by an intersection point between the second lateral portions (Ac2) of the outer wall outline and the first transverse axis, x. The second tight gap width, Gt2, is not more than half, or not more than a third of a second flared gap width, Gf2, of a second flared gap between the cavity wall outline and the second lateral portions (Ac2) of the outer wall outline measured at the first side of the first transverse axis, x, along the segment, n, (2 Gt2≤Gf2).

Ignoring any movements of the slab nozzle with respect to the mould cavity during continuous casting operations, since the mould cavity is symmetrical at least with respect to the central point, c, the first tight width, Gt1, Is substantially equal to the second tight gap width, Gt2, (Gt1=Gt2), and Gt1 and Gt2 may be comprised between 10 and 70% of a maximum thickness, Tx, of the outer wall outline of the slab nozzle measured along the second transverse axis, y, (0.1 Tx≤Gt1≤0.7 Tx, with i=1 or 2). Similarly, the first flared gap width, Gf1, is substantially equal to the second flared gap width, Gf2, (Gf1=Gf2).

For example, a mould cavity may have a maximum thickness, Tmx=74–162 mm, depending on whether or not the mould cavity comprises a funnel shaped central cavity portion (i.e., whether Wmx is equal to or greater than 0). For such mould cavity, a thin slab nozzle can be used having a maximum thickness, Tx=60 mm, and the tight gap width, Gt1, Gt2, can be comprised between 6 and 42 mm, in general, about 25 mm. With a mould cavity having a maximum thickness, Tmx=156 to 251 mm, a slab nozzle can be used having a maximum thickness, Tx=130 mm. The tight gap width, Gt1, Gt2, can be comprised between 13 and 91 mm, in general, about 40 mm.

The geometries of the metallurgic assembly defined supra with respect to a cut along the transverse plane, P3, preferably also apply to any cut along any transverse plane, Pm, defined as a plane normal to the longitudinal axis, z, and intersecting the downstream portion of the nozzle slab, over at least 40%, or at least 50%, or at least 75% of the inserted length, U. The transverse planes, Pm, may intersect the downstream portion of the nozzle slab above the downstream end of the slab at least 1%, or at least 5% of the inserted length, Li, above the downstream end. For example, the following magnitudes defined with respect to the cut along plane, P3, also apply for cuts along a plane, Pm:

first and second tight gap widths, Gt1, Gt2, first and second flared gap widths, Gf1, Gf2, central cavity width, Wmx, and cavity thicknesses, Tmc, Tmx, nozzle width, W, nozzle thicknesses, T, Tx By preferentially deviating around the slab nozzle the two opposite converging molten metal streams flowing towards the two flanks of the slab nozzle, achieved by the specific geometry of the slab nozzle of the present invention, the impact or impinging area between the two opposite streams, normally located in the narrow channels between mould and slab nozzle is shifted away from the slab nozzle, and the turbulences thus created have substantially less impact on the erosion of the slab nozzle outer wall. The service life of the slab nozzle can thus be substantially prolonged. A slab nozzle according to the present invention can be used in any existing metallurgic installation and yield the foregoing advantages without any change in the rest of the installation. The round-about effect permits a substantial reduction of the erosion rate of the slab nozzle outer wall.

Various features and characteristics of the invention are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The inventor and the Applicant expressly intend such combinations of features and characteristics to be included within the scope of this specification, and further intend the claiming of such combinations of features and characteristics to not add new matter to the application. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with the written description requirement under 35 U.S.C. § 112(a). The invention described in this specification can comprise, consist of, or consist essentially of the various features and characteristics described in this specification.

| Ref # | Feature |
|---|---|
| 1 | Slab nozzle |
| 5 | protrusions |
| 7 | Stopper |
| 42 d | Slab nozzle downstream end |
| 42 u | Slab nozzle upstream end |
| 46 d | Slab nozzle downstream portion |
| 50 u | inlet orifice |
| 50 | central bore |
| 51 | front port |
| 51 d | outlet port orifices |
| 70 a | metal melt stream flowing in channel 111 in one direction |
| 70 b | metal melt stream flowing in channel 111 in opposite direction to stream 70a |
| 100 | Metallurgic vessel |
| 101 | Tundish outlet orifice |
| 105 | Slag layer formed on top of mould |
| 110 | mould |
| 110 c | Mould cavity |
| 111 | Channels formed on either side of a slab nozzle with the mould cavity wall |
| A c1 | first lateral portion |
| A c2 | second lateral portion |
| A f | area comprised between the outer wall outline and the edges of the virtual rectangle joining at the first and second diagonally opposed corners |
| A t | area comprised between the outer wall outline and the edges of the virtual rectangle joining at the other two diagonally opposed corners |
| A x | central bore |
| d f | Flared distance of the outer wall outline to the other two diagonally opposed corners |
| d t | Tight distance of the outer wall outline to first and second diagonally opposed corners |
| G f1 | first flared gap |
| G f2 | second flared gap |
| G t1 | first tight gap |
| G t2 | second tight gap |
| L 3 | distance between plane P3 and slab nozzle downstream end |
| L i | inserted length |
| L n | distance of Pn to the downstream end |
| L | Nozzle length |

-continued

| Ref # | Feature |
|---|---|
| P3 | transverse plane normal to z, and intersecting an outlet port orifices at the largest distance, L3 |
| P m | plane normal to z, and intersecting the downstream portion of the nozzle slab inserted in cavity |
| P n | plane normal to the longitudinal axis, z, and intersecting the longitudinal axis, z, at a distance, Ln, to the downstream end |
| Q 1 | reference plane (x, z) |
| Q 2 | reference plane (y, z) |
| Q 3 | reference plane (x, y) |
| T m | mould cavity thickness |
| T mc | lateral cavity thickness |
| T mx | maximum cavity thickness |
| T x | Maximum nozzle thickness |
| T | nozzle thickness |
| W m | mould cavity width |
| W mx | width of central cavity portion |
| W | nozzle width |
| x | first transverse axis (normal to y and z) |
| y | second transverse axis (normal to x and z) |
| z | longitudinal axis (normal to x and y) |

What is claimed is:

1. Slab nozzle for casting slabs made of metal, said slab nozzle having a geometry defined by an outer wall extending over a nozzle length, L, along a longitudinal axis, z, from an upstream end to a downstream end, said slab nozzle comprising a slab nozzle downstream portion extending along the longitudinal axis, z, from and including the downstream end, wherein the upstream end of the slab nozzle comprises an inlet orifice oriented parallel to said longitudinal axis, z, and wherein the downstream portion of the slab nozzle comprises one or more outlet port orifices, said downstream portion being defined by a width measured along a first transverse axis, x, which is at least 1.5 times larger than a thickness of the downstream portion measured along a second transverse axis, y, wherein the first transverse axis, x, is normal to the longitudinal axis, z, and wherein the second transverse axis, y, is normal to both first transverse axis, x, and longitudinal axis, z, said slab nozzle further comprising a central bore opening at said inlet orifice, extending therefrom along the longitudinal axis, z, and intersecting one or more front ports each opening at the one or more outlet port orifices, wherein, in a section of the slab nozzle along a transverse plane, P3, the outer wall of the slab nozzle is defined by an outer wall outline which comprises:

a central portion (Ax) wherein the outer wall outline is symmetrical with respect to a central point, c, defined as an intersection point between the longitudinal axis, z, and the transverse plane, P3, and is symmetrical with respect to both first and second transverse axes, x, y, and said central portion being flanked by a first and second lateral portions (Ac1, Ac2), positioned on either side of the central portion (Ax) along the first transverse axis, x, and wherein the outer wall is symmetrical solely with respect to the central point, c, the outer wall outline of the downstream portion is inscribed in a virtual rectangle of first and second edges parallel to the first transverse axis, x, and third and fourth edges parallel to the second transverse axis, y, and wherein a tight distance, dt, of the outer wall outline to first and second diagonally opposed corners of the four corners of the virtual rectangle is at least 1.5 times shorter than a flared distance, df, of the outer wall outline to the other two diagonally opposed corners of the virtual rectangle, wherein the distance of the outer wall outline to a corner is defined as the distance between said corner and a point of the outline located closest to said corner, wherein the transverse plane, P3, is the plane normal to the longitudinal axis, z, and intersecting the one or more outlet port orifices, which produces a maximum distance L3 between the transverse plane, P3, and the downstream end.

2. Slab nozzle according to claim 1, wherein the width of the downstream portion is at least three times larger than the thickness of the downstream portion.

3. Slab nozzle according to claim 1, comprising a first and second front ports opening at a corresponding first and second outlet port orifices, wherein the first and second front ports are separated from one another by a divider extending in the central bore from the downstream end along the longitudinal axis, z.

4. Slab nozzle according to claim 1, wherein the tight distance, dt, is at least twice shorter than the flared distance, df, and wherein the tight distance, dt, is not more than ten times shorter than the flared distance, df.

5. Slab nozzle according to claim 4, wherein each of a first and second tight areas, At, comprised between the outer wall outline and the edges of the virtual rectangle joining at the first and second diagonally opposed corners, respectively has an area of not more than 80% of an area of a first and second flared areas, Af, comprised between the outer wall outline and the edges of the virtual rectangle joining at the other two diagonally opposed corners.

6. Slab nozzle according to claim 4, wherein protrusions are distributed on a first and second hindered portions of the outer wall of the downstream portion, said first and second hindered portions, corresponding to the portion of the outer wall outline in the a cut along the plane, P3, which is contained in the two diagonally opposed quarters of the virtual rectangle including the tight distance, dt, or the tight area, At.

7. Slab nozzle according to claim 6, wherein the protrusions have a geometry selected from the group consisting of circles, ellipses, straight lines, curved lines, chevrons, arcs of circles, and polygons, protruding out of the surface of the outer wall of the downstream portion by at least 3 mm, and by not more than 20 mm, and wherein the protrusions are discrete protrusions distributed in a staggered arrangement on the first and second hindered portions of the outer wall of the downstream portion.

8. Slab nozzle according to claim 1, wherein the one or more front ports flare out as they open at the corresponding outlet port orifices.

9. Slab nozzle according to claim 3, wherein in the section of the slab nozzle along the transverse plane, P3, the first and second front ports are defined by a first and second front ports outlines each comprising a lateral portion remote from the divider which is symmetrical solely with respect to the central point, c, and is substantially parallel to the corresponding first and second lateral portions (Ac1, Ac2) of the outer wall outline.

10. Slab nozzle according to claim 3, wherein the central portion (Ax) of the outer wall outline extends over at least 33% of the width, W, of the first and second edges of the virtual rectangle, and extends not more than 85% of the width, W, of the first and second edges of the virtual rectangle.

11. Slab nozzle according to claim 1, wherein in sections of the slab nozzle along any transverse plane, Pn, the outer wall of the slab nozzle is defined by an outer wall outline which comprises a central portion and a first and second lateral portions as defined in claim 1 with respect to the transverse plane, P3, wherein a transverse plane, Pn, is a plane normal to the longitudinal axis, z, and intersecting the longitudinal axis, z, at a distance, Ln, to the downstream end of not more than 60% of the nozzle length, L.

12. Metallurgic assembly for casting metal slabs, said metallurgic assembly comprising:

a metallurgic vessel comprising a bottom floor provided with an outlet, a slab mould extending along a longitudinal axis, z, defined by a width, Wm, measured along a first transverse axis, x, and by a thickness, Tm, measured along a second transverse axis, y, wherein x⊥y⊥z, and comprising a mould cavity defined by cavity walls and opening at an upstream end of the cavity, and a slab nozzle for casting slabs made of metal, said slab nozzle having a geometry defined by an outer wall extending over a nozzle length, L, along a longitudinal axis, z, from an upstream end to a downstream end, said slab nozzle comprising a slab nozzle downstream portion extending along the longitudinal axis, z, from and including the downstream end, wherein the upstream end of the slab nozzle comprises an inlet orifice oriented parallel to said longitudinal axis, z, and wherein the downstream portion of the slab nozzle comprises one or more outlet port orifices, said downstream portion being defined by a width measured along a first transverse axis, x, which is at least 1.5 times larger than a thickness of the downstream portion measured along a second transverse axis, y, wherein the first transverse axis, x, is normal to the longitudinal axis, z, and wherein the second transverse axis, y, is normal to both first transverse axis, x, and longitudinal axis, z, said slab nozzle further comprising a central bore opening at said inlet orifice, extending therefrom along the longitudinal axis, z, and intersecting one or more front ports each opening at the one or more outlet port orifices, wherein, in a section of the slab nozzle along a transverse plane, P3, the outer wall of the slab nozzle is defined by an outer wall outline which comprises:

a central portion (Ax) wherein the outer wall outline is symmetrical with respect to a central point, c, defined as an intersection point between the longitudinal axis, z, and the transverse plane, P3, and is symmetrical with respect to both first and second transverse axes, x, y, and said central portion being flanked by a first and second lateral portions (Ac1, Ac2), positioned on either side of the central portion (Ax) along the first transverse axis, x, and wherein the outer wall is symmetrical solely with respect to the central point, c, the outer wall outline of the downstream portion is inscribed in a virtual rectangle of first and second edges parallel to the first transverse axis, x, and third and fourth edges parallel to the second transverse axis, y, and wherein a tight distance, dt, of the outer wall outline to first and second diagonally opposed corners of the four corners of the virtual rectangle is at least 1.5 times shorter than a flared distance, df, of the outer wall outline to the other two diagonally opposed corners of the virtual rectangle, wherein the distance of the outer wall outline to a corner is defined as the distance between said corner and a point of the outline located closest to said corner, wherein the transverse plane, P3, is the plane normal to the longitudinal axis, z, and intersecting the one or more outlet port orifices, which produces a maximum distance L3 between the transverse plane, P3, and the downstream end. wherein the upstream end of the slab nozzle is coupled to the bottom floor of the metallurgic vessel such that the outlet is in fluid communication with the inlet orifice, and wherein the downstream portion of the slab nozzle is inserted in the cavity of the slab mould over an inserted length, Li, measured between the upstream end of the mould cavity and the downstream end of the slab nozzle, and in alignment with the longitudinal axis, z, and the first and second transverse axes, x, y.

13. Metallurgic assembly according to claim 12, wherein in a section of the metallurgic assembly along the transverse plane, P3, comprises, a first tight gap between the cavity wall outline and the first lateral portions (Ac1) of the outer wall outline having a first tight gap width, Gt1,measured at a first side of the first transverse axis, x, along a segment, m, parallel to the second transverse axis, y, and passing by an intersection point between the first lateral portions (Ac1) of the outer wall outline and the first transverse axis, x, which is not more than half of a first flared gap width, Gf1, of a first flared gap between the cavity wall outline and the first lateral portions (Ac1) of the outer wall outline measured at a second side of the first transverse axis, x, along the segment, m, wherein a second tight gap between the cavity wall outline and the second lateral portions (Ac2) of the outer wall outline having a second tight gap width, Gt2, measured at the second side of the first transverse axis, x, along a segment, n, parallel to the second transverse axis, y, and passing by an intersection point between the second lateral portions (Ac2) of the outer wall outline and the first transverse axis, x, which is not more than half of a second flared gap width, Gf2, of a second flared gap between the cavity wall outline and the second lateral portions (Ac2) of the outer wall outline measured at the first side of the first transverse axis, x, along the segment, n, the first tight width, Gt1, is substantially equal to the second tight gap width, Gt2, and Gt1 and Gt2 are comprised between 10 and 70% of a maximum thickness of the outer wall outline of the slab nozzle measured along the second transverse axis, y; and the first flared gap width, Gf1, is substantially equal to the second flared gap width, Gf2.

14. Metallurgic assembly according to claim 1, wherein a section of the metallurgic assembly along the transverse plane, P3, the cavity of the slab mould is defined by a cavity wall outline which comprises, a first and second cavity lateral portions having a lateral cavity thickness, Tmc, which is substantially constant, said first and second cavity lateral portions being aligned over the first transverse axis, x, and flanking on either side, a central cavity portion, having a central cavity width, Wmx, wherein the cavity wall outline is symmetrical with respect to both first and second transverse axes, x, y, having a thickness equal to Tmc on either side where it joins the first and second lateral portions, and evolving smoothly until reaching a maximum cavity thickness value, Tmx, at the intersection points between the cavity wall outline and the second transverse axis, y, and wherein Tmx can be same as or different from Tmc, and the outer wall outline of the slab nozzle:

has a nozzle width, W, measured along the first transverse direction, x, which is smaller than the central cavity width, Wmx, has a nozzle thickness, T, measured along the second transverse axis, y, having a maximum value, Tx, and wherein, the thickness ratio, Tmx/Tx, of the slab mould to the slab nozzle is comprised between 1.2 and 2.7.

15. Metallurgic assembly according to claim 13, wherein one or more of the following magnitudes, the first and second tight gap widths, Gt1, Gt2, the first and second flared gap widths, Gf1, Gf2, defined in claim 13 with respect to a section along the transverse plane, P3, are equivalently defined in any section of the metallurgic assembly along any transverse plane, Pm, wherein a transverse plane, Pm, is a plane normal to the longitudinal axis, z, and intersecting the downstream portion of the nozzle slab, over at least 40% of the inserted length, Li.

16. Metallurgic assembly according to claim 14, wherein one or more of the following magnitudes, the central cavity width, Wmx, and the cavity thicknesses, Tmc, Tmx, the nozzle width, W, and the nozzle thicknesses, T, Tx, defined in claim 14 with respect to a section along the transverse plane, P3, are equivalently defined in any section of the metallurgic assembly along any transverse plane, Pm, wherein a transverse plane, Pm, is a plane normal to the longitudinal axis, z, and intersecting the downstream portion of the nozzle slab, over at least 40% of the inserted length, Li.

* * * * *